United States Patent [19]

Leonard

[11] 3,973,116

[45] Aug. 3, 1976

[54] MINIATURE LIGHTING FIXTURE AND METHODS OF MANUFACTURE AND ASSEMBLY

[75] Inventor: Edward J. Leonard, Geneva, Ill.

[73] Assignee: Illinois Hobbycraft, Inc., Geneva, Ill.

[22] Filed: Oct. 10, 1974

[21] Appl. No.: 513,532

[52] U.S. Cl. ..... 240/78 F; 174/117 A; 240/81 R; 240/85 R

[51] Int. Cl.[2] ..... F21S 1/06; F21S 3/06

[58] Field of Search ..... 240/78 R, 78 F, 78 C, 240/73 BA, 10 R, 10 T, 81 R, 85, 148; 174/117 A

[56] References Cited

UNITED STATES PATENTS

| | | | |
|---|---|---|---|
| 1,563,048 | 11/1925 | Stien | 240/10 T |
| 1,762,526 | 6/1930 | Riddle | 240/78 F |
| 2,113,134 | 4/1938 | Godfrey | 240/73 BA |
| 2,258,108 | 10/1941 | Calissi | 240/81 R |
| 2,457,521 | 12/1948 | Benander | 240/85 R X |
| 2,482,656 | 9/1949 | Conroy et al. | 240/10 T X |
| 3,074,677 | 1/1963 | Eckhardt | 174/117 A |
| 3,300,635 | 1/1967 | Ramsey, Jr. | 240/78 R |

FOREIGN PATENTS OR APPLICATIONS

| | | | |
|---|---|---|---|
| 198,739 | 1/1923 | United Kingdom | 174/117 A |

*Primary Examiner*—Richard A. Wintercorn
*Attorney, Agent, or Firm*—Mason, Kolehmainen, Rathburn & Wyss

[57] ABSTRACT

A miniature lighting fixture for use in rooms like those found in miniature-scale houses includes a frame, a base and a lamp or light source mounted in the base having leads attached thereto for connecting the lamp to an electrical source. The frame further includes a groove extending around its periphery into which the leads extending from the light source are disposed. The leads are secured in the groove by cement and extend around the frame to a point at which the leads are directed away from the frame for connection to an electrical power source. The frame and leads are then painted such that the presence of the leads about the frame is not readily discernible. The frame of the lighting fixture is manufactured by individually molding identical sections of the complete frame wherein each section preferably includes only one elongated radial extension or arm of the frame. The molded sections preferably include mating tongue and groove configurations to enable the molded sections to be joined together as a complete frame with the joints between sections being visually indiscernible.

6 Claims, 12 Drawing Figures

MINIATURE LIGHTING FIXTURE AND METHODS OF MANUFACTURE AND ASSEMBLY

BACKGROUND OF THE INVENTION

A. Field of the Invention

The device of the present invention generally relates to illumination devices and, more particularly, to a new and improved miniature lighting fixture for use in miniature-scale models of homes or the like and to new and improved methods for manufacturing and assembling the lighting fixture.

B. Description of the Prior Art

In the hobby of miniature room and doll house construction, the enthusiasts continually strive for the maximum in accuracy, both in the construction of the miniature rooms and the doll houses and in the accessories, such as lighting fixtures. Prior art lighting fixtures available for use as accessories for small rooms and doll houses have employed hollow tubes extending through the middle of the lamp in a manner similar to full-scale lamps so that the wire leads connected to the light bulbs pass inconspicuously through the hollow tube from the light bulbs to an electrical source.

This prior art procedure of constructing lighting fixtures for doll houses or miniature rooms results in bulky accessories which are difficult to construct to exact scale thereby distorting the appearance of the miniature room or doll house. Additionally, prior art construction procedures employ brass tubing bent into the desired configuration. This bending requires the utilization of special forms and bending apparatus to prevent kinks in the tubing. The existing tolerances in brass tubing and variances in the material result in the introduction in the tubing of small kinks during bending, thereby preventing threading of the wires and greatly increasing the complexity of assembly. Moreover, these features of the prior art fixtures render assembly more difficult preventing the fixture from being offered in kit form for assembly by the hobbyists.

In addition, prior art frames are constructed either by molding the frame portions as tubes having a hollow core or molding the frame portions as solid members and then drilling out a core. These construction techniques result in increased complexity of manufacture and in increased production costs. Moreover, the bulky construction of such miniature lighting fixtures prevents the production of certain types of lamps, such as an antique store lamp and an antique library lamp, since various portions of the frame of these lamps require fine or thin members which cannot be made to scale if required to be hollow.

Typically, prior art miniature lighting fixtures having complex designs are molded from iron casts that are segmented such that after the mold has set, the segments are removed from between portions of the molded fixture. The resultant fixture is a solid unit that may not be electrified.

SUMMARY OF THE INVENTION

An object of the present invention is to provide a new and improved light source for a miniature-scale building or room.

Another object of the present invention is to provide a new and improved method for manufacturing and assembling a light source for a miniature room or building.

A further object of the present invention is to provide a new and improved method for molding a light source for a miniature room or building.

An additional object of the present invention is to provide a miniature lighting fixture that is easy to assemble.

Briefly, the present invention is directed to a new and improved miniature lighting fixture that provides light and a realistic appearance in a miniature room, doll house or the like. The miniature lighting fixture includes a molded frame that is a scale model of a full-size lamp. In accordance with an important feature of the present invention, the miniature lighting fixture includes a groove around a portion of the surface of the frame. The miniature lighting fixture further includes a mounting structure attached to the frame for receiving a light source. The light source has two wire leads attached to it for connection to a source of electrical power.

In accordance with another important feature of the present invention, the leads are attached or cemented into the groove to a point along the frame where the leads extend from the frame for connection to a source of electrical power. The frame is then painted a desired color such that the presence of the wire leads is not readily discernible.

In accordance with a further important feature of the present invention, the inventive miniature lighting fixture is molded by means of a novel casting process. In accordance with this novel casting process, a plurality of substantially identical sections of the miniature lighting fixture frame are individually molded. Preferably, each section includes only one elongated radial extension or arm of the frame. After the sections are molded, they are assembled to form a complete lighting fixture frame.

BRIEF DESCRIPTION OF THE DRAWINGS

The above and other objects and advantages and novel features of the present invention will become apparent from the following detailed description of a preferred embodiment of and several alternate embodiments of the present invention illustrated in the accompanying drawings wherein:

FIG. 8 is an enlarged, partially cross-sectional and partially elevational view of the device of FIG. 7 taken along line 8—8 of FIG. 7;

DESCRIPTION OF THE PREFERRED EMBODIMENT

Figures 1, 2, 3, 4, 5, 6:
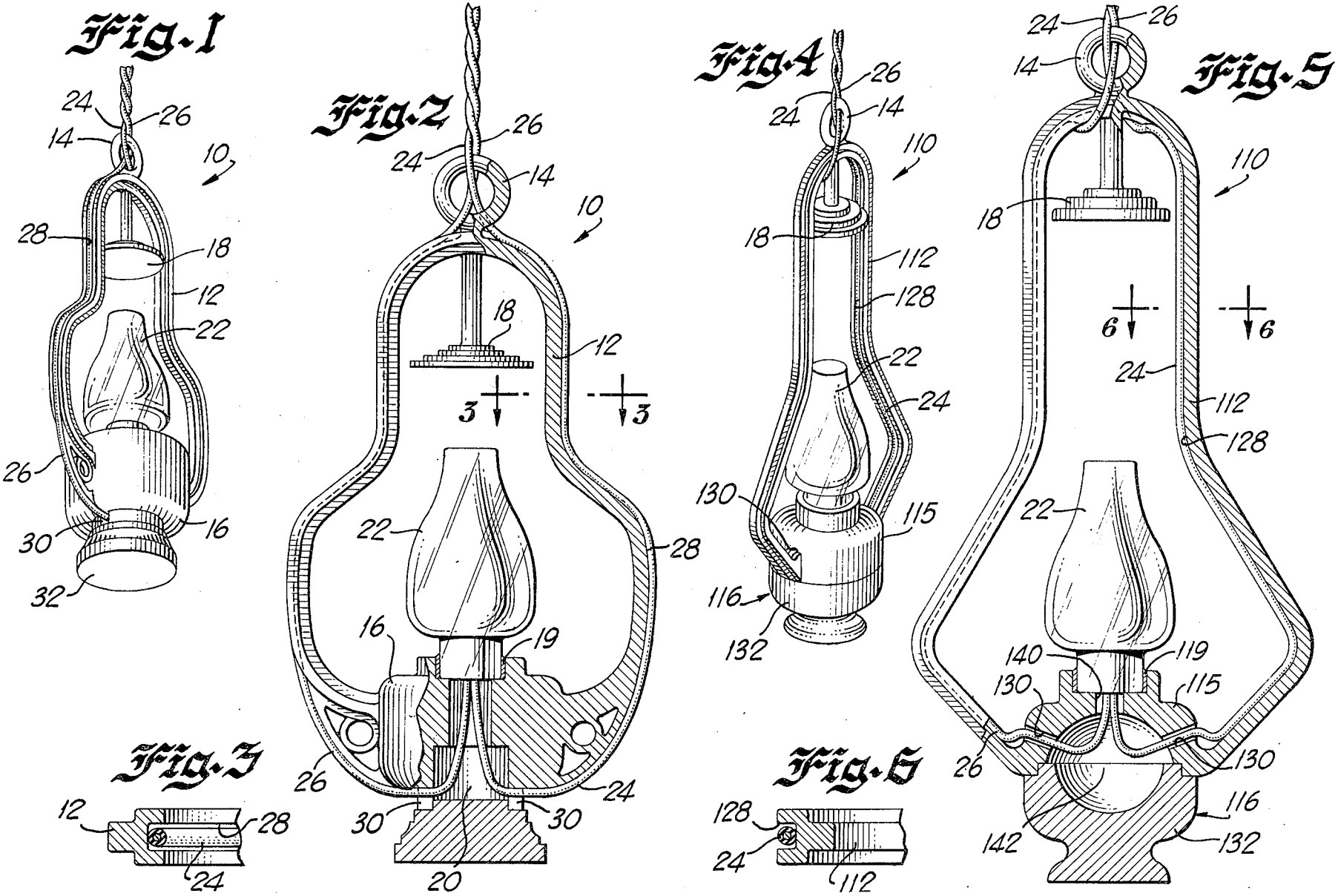
FIG. 1 is a lower perspective view of a miniature lighting fixture constructed in accordance with the principles of the present invention.
FIG. 2 is an enlarged, fragmentary view of the device of FIG. 1.
FIG. 3 is a fragmentary, partially cross-sectional and partially elevational view of a portion of the device of FIG. 1 taken along line 3—3 of FIG. 2.
FIG. 4 is an upper perspective view of an alternate embodiment of the device of the present invention.
FIG. 5 is an enlarged, fragmentary view of the device of FIG. 4.
FIG. 6 is a fragmentary, partially cross-sectional and partially elevational view of the device of FIG. 4 taken along line 6—6 of FIG. 5.
Figures 5, 7, 9, 10, 11, 12:
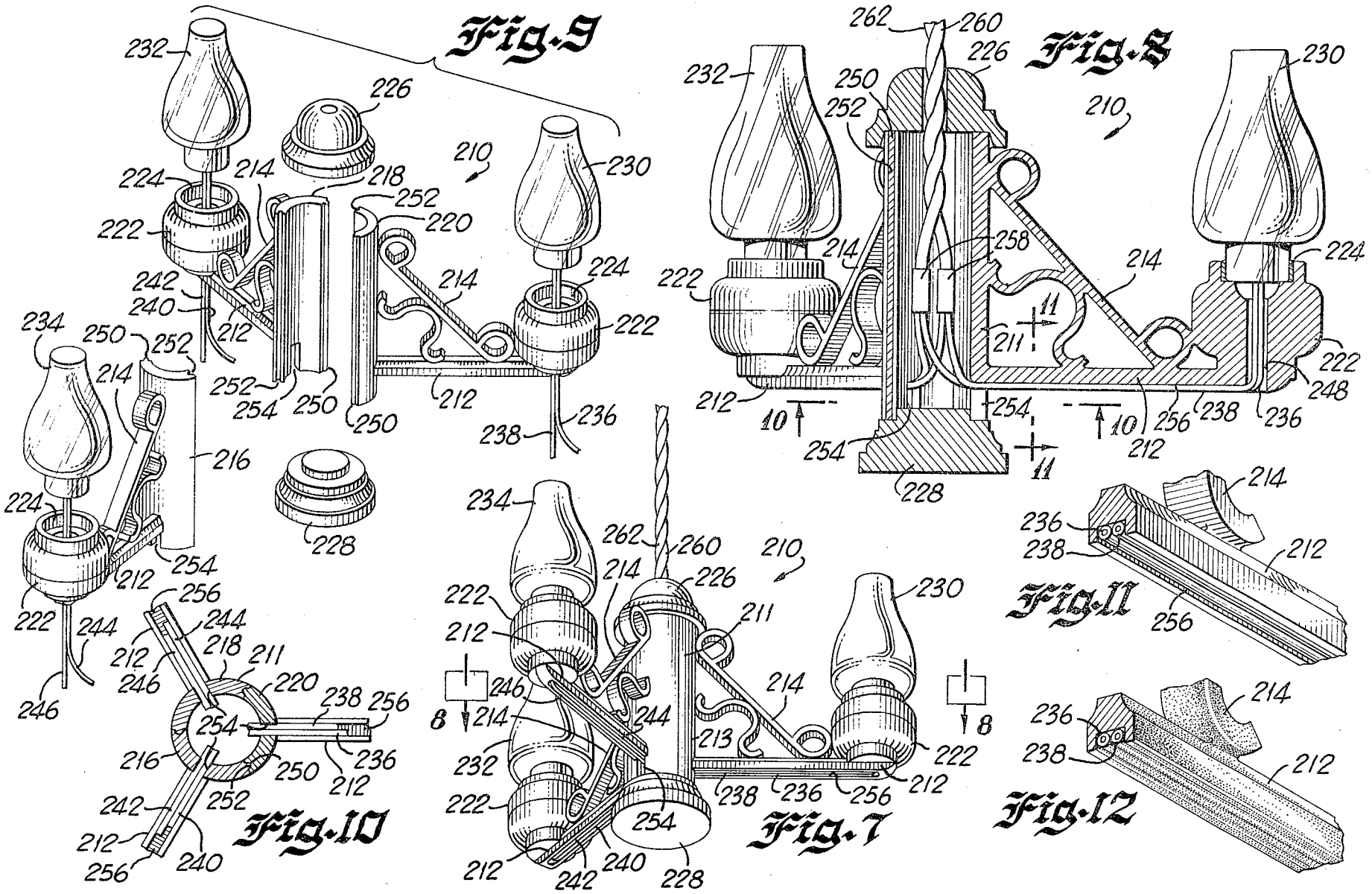
FIG. 7 is a lower perspective view of an alternate embodiment of the device of the present invention.
FIG. 9 is an exploded, upper perspective view of the device of FIG. 7.
FIG. 10 is an enlarged, fragmentary cross-sectional view of a portion of the device of FIG. 7 taken along line 10—10 of FIG. 8.
FIG. 11 is an enlarged, fragmentary, elevational view of a portion of the device of FIG. 7 taken from line 11—11 of FIG. 8.
FIG. 12 is a view similar to the view of FIG. 11 of a portion of the device of FIG. 7 prepared in accordance with the principles of the present invention.

With reference to FIGS. 1–3, there is illustrated a new and improved miniature lighting fixture 10 constructed in accordance with the principles of the present invention. The lighting fixture 10 is molded in the configuration of an antique library lamp and may be used as an accessory for miniature rooms, such as those found in doll houses. The lighting fixture 10 may be mounted to the ceiling or similar surface in a miniature room and connected to an electrical source to provide light and an authentic appearance. The fixture 10 includes a molded frame 12 having an integrally formed top ring 14. The frame 12 further includes an integrally molded oil fount 16 at its lower portion and an integrally molded deflector 18 at its upper end.

Preferably, the oil fount 16 includes a lamp seat 19 and a centrally disposed aperture or hollow portion 20. In accordance with an important feature of the present invention, the fixture 10 also includes a miniature chimney bulb 22 having a pair of wire leads 24 and 26 electrically connected to and extending from the bottom portion of the chimney bulb 22. The frame 12 of the fixture 10 includes an outer peripheral groove 28 having a depth approximately equal to the diameter of the leads 24 and 26.

In assembling the fixture 10, the chimney bulb 22 is positioned within the seat 19, the leads 24 and 26 are drawn through the opening 20 and through a pair of slots 30 located at the lower portion of the oil fount 16. The leads 24 and 26 are cemented in the groove 28 along the frame 12 to a point adjacent the ring 14. At this point, the leads 24 and 26 extend from the groove 28, and are directed away from the frame 12. The leads 24 and 26 may then be drawn through the ceiling of a miniature room and connected to a power source in order to energize the chimney bulb 22.

The next step in assembling the fixture 10 involves cementing a base 32 to the lower portion of the fount 16. Finally, the frame 12, the fount 16, the base 32 and the leads 24 and 26 in the groove 28 are painted with an authentic metallic color paint. The resulting miniature lighting fixture 10 includes an attractive frame 12 having little evidence of the presence of the leads 24 and 26.

FIGS. 4–6 depict an alternate embodiment of the present invention in the form of a miniature lighting fixture 110 wherein parts substantially identical in form and function to parts illustrated in the embodiment of FIGS. 1–3 are identified by the same numerical designations. The fixture 110 includes a frame 112, a top ring 14 and a deflector 18. The fixture 110 is fashioned after an antique store lamp and includes a chimney bulb 22 having a pair of wire leads 24 and 26 electrically connected thereto and extending therefrom. The chimney bulb 22 is mounted in a seat 119 formed in an upper portion 115 of an oil fount 116. A centrally disposed aperture or opening 140 is formed in the upper portion 115 of the fount 116. The leads 24 and 26 are drawn through the opening 140 into a chamber 142 formed by the inner periphery of the upper portion 115 and a lower portion 132 of the fount 116. In addition, a pair of openings 130 are provided in the upper portion 115 of the fount 116 for receiving the leads 24 and 26 therethrough. A groove 128 is formed along the inner periphery of the frame 112 and is of a depth approximately equal to the diameter of the leads 24 and 26.

In assembling the fixture 110, the chimney bulb 22 is cemented in the seat 119; and the leads 24 and 26 are directed through the opening 140, the chamber 142 and the openings 130. The leads 24 and 26 are then cemented in the groove 128 to a point at the top of the frame 112, whereupon the leads 24 and 26 extend from the groove 128 for connection to a power source. The lower portion 132 of the fount 116 is then cemented to the upper portion 115 to form the base of the fixture 110. Finally, the frame 112, the fount 116 and the leads 24 and 26 located in the groove 128 are painted to mask the presence of the leads 24 and 26 about the inner periphery of the frame 112.

A miniature lighting fixture 210 (FIGS. 7–12), a third embodiment of the present invention, is formed in the configuration of a three lamp antique chandelier. The fixture 210 includes a frame 211 having a plurality of elongated radial extensions or arms 212 and a centrally disposed, tubular body portion 213. Each arm 212 includes a decorative scroll portion 214. The frame 211 is formed by three substantially identical sections 216, 218 and 220, each having an arm 212 and a radial portion of the body portion 213 extending over an arc approximately equal to $360°/n$; $n$ being the number of radial extensions or arms 212.

The molding process used to manufacture the fixture 210 is simplified by forming the frame 211 from the three substantially identical sections 216, 218 and 220, each of which is individually molded and then assembled with two other sections to form the frame 211. By molding the frame 211 in sections (FIG. 7), the molding cast is simplified and delineates only one arm 212 and its included decorative scroll work 214 both extending in essentially a single plane. This method of manufacture enables the frame 211 to be molded without requiring a relatively complex and expensive molding cast having the required undercuts or angle cuts necessary to form the frame 211 as a unitary member.

Each arm 212 includes an integrally formed lamp base 222 with a chimney lamp seat 224. In addition, the fixture 210 includes a top plate 226 and a bottom plate 228 positioned on the top and bottom ends, respectively, of the body portion 213. The fixture 210 also includes a plurality of chimney lamp bulbs 230, 232 and 234 and a plurality of wire leads 236, 238, 240, 242, 244 and 246 for energizing the bulbs 230, 232 and 234. Each lamp base 222 further includes a channel 248 through which a pair of the leads 236, 238, 240, 242, 244 and 246 extend. The lower portion of each arm 212 includes a molded or formed groove 256 having a depth approximately equal to the diameter of the leads 236, 238, 240, 242, 244 and 246 and a width approximately equal to twice the depth.

In accordance with an important feature of the present invention, the sections 216, 218 and 220 of the frame 211 each include a tongue 250 extending along one edge portion, a groove 252 extending along another edge portion; and a slot 254 at a lower edge portion for receiving a pair of the leads 236, 238, 240, 242, 244 and 246.

To assemble the frame 211, mating channels 250 and grooves 252 on the sections 216, 218 and 220 are interfitted and secured by cement to form a single frame 211 having a smooth exterior surface on its body portion 213 such that the mating edges of the sections 216, 218 and 220 are substantially, visually indiscernible.

Each bulb 230, 232 and 234 is secured by cement to its corresponding lamp seat 224 such that its individual leads pass through the channel 248 in the lamp base 222. The leads are positioned with respective groove 256 and secured by cement. The leads 236, 238, 240, 242, 244 and 246 extend through a plurality of slots or openings 254 and into the body portion 213 of the frame 211 and are spliced by a pair of connectors 258 to a pair of drop wire leads 260 and 262. The leads 260 and 262 are directed to an electric power source (not shown) to thereby energize the bulbs 230, 232 and 234.

The cap 226 and the base 228 are cemented to the body portion 213 of the frame 211. The entire fixture 210, excluding the bulbs 230, 232 and 234, is then painted an authentic color to provide a miniature fixture 210 having the appearance of a three lamp antique chandelier. Painting the fixture 210 additionally masks the presence of the leads 236, 238, 240, 242, 244 and 246.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A miniature lighting fixture comprising a frame, means attached to said frame for supporting a light source, a light source mounted in said support means and electrical leads attached to said light source, said frame including a groove formed in at least an elongated portion of the periphery of said frame for receiving and retaining said leads wherein said groove extends around the periphery of said frame and said leads are cemented along said groove to a point at an upper portion of said frame whereat said leads extend from said groove and from said frame.

2. A miniature lighting fixture as defined in claim 1 wherein said supporting means comprises a plurality of support bases attached to said frame and wherein at least one miniature light bulb is mounted in each of said support bases.

3. The miniature lighting fixture as claimed in claim 1 wherein said groove extends around the inner periphery of said frame and said leads are cemented along said groove to a point at an upper portion of said frame whereat said leads extend from said groove and from said frame.

4. The miniature lighting fixture as claimed in claim 1 further including paint covering said frame, said support means and said leads in said grooves.

5. A method of manufacturing a miniature lighting fixture having a centrally disposed body portion and a plurality of radially outwardly extending elongated portions or arms extending from said body portion comprising the steps of molding individually a plurality of substantially identical sections each having a portion of said body portion and one of said arms wherein the portion of said body portion extends over an arc equal to $360°/n$, $n$ being the number of arms and forming mating tongue and groove configurations on confronting edges of said sections.

6. The miniature lighting fixture as claimed in claim 1 wherein said groove extends around the outer periphery of said frame.

* * * * *